United States Patent [19]

Howell

[11] 3,967,274

[45] June 29, 1976

[54] SIGNAL LIGHT

[76] Inventor: Colvard W. Howell, 829 E. McIntosh, Griffin, Ga. 30223

[22] Filed: Oct. 21, 1974

[21] Appl. No.: 516,442

[52] U.S. Cl. ..... 340/380; 240/6.4 R; 240/10.66; 340/321

[51] Int. Cl.[2] ..... G08B 5/00

[58] Field of Search ..... 240/1 LP, 2 R, 2 CL, 240/2 SL, 6.4 R, 6.4 CL, 10 B, 10.6 R, 10.64, 10.66, 10.68; 340/380

[56] References Cited

UNITED STATES PATENTS

| | | | |
|---|---|---|---|
| 1,225,491 | 5/1917 | Recker | 240/10.64 X |
| 2,431,091 | 11/1947 | Thomas | 240/10.66 X |
| 2,465,426 | 3/1949 | Bralove | 240/10.64 UX |
| 2,489,806 | 11/1949 | Oliver | 240/10.66 |
| 2,565,980 | 8/1951 | Moore | 240/6.4 R X |
| 3,097,797 | 7/1963 | Crain | 240/2 R |

*Primary Examiner*—Fred L. Braun

[57] ABSTRACT

A signal light, which optionally may be combined with an ashtray base, having a quick-flip switch and a light conducting rod at the top so that when a patron of a restaurant or bar wishes immediate service the switch actuator is flipped and the light comes on to signal the desirability for service. The device comprises a tubular housing in which housing there is a spring for supporting batteries and the housing is mounted on a large circular base which may serve as an ashtray. The switch comprises a lightweight wire switch actuator which has small handles on both sides protruding from the top of the battery housing and a wire loop projection on the actuator which moves between electrical contact from the side of the battery housing to the small light bulb which is mounted on a non-conductor plastic collar fitting in which there is carried a rod of "LUCITE" (trademark) or other similar material.

4 Claims, 6 Drawing Figures

SIGNAL LIGHT

FIELD OF THE INVENTION

Signal light and devices and particularly self-contained battery devices having switch means thereon.

DESCRIPTION OF THE PRIOR ART

It is believed by many proprietors of bars and lounges that sales of drinks are lost because the customer cannot signal the waiter or waitress at the time the desire for the drink is compelling.

The prior art includes lamps and flashlights and devices which may be turned on and off as desired. In addition, there are devices which are properly classified as enunciator devices signaling to a waiter or waitress for service. The lamp and battery operated flashlight devices are not arranged conveniently for placement on a restaurant table or on the bar and are not provided with convenient and easily operated switch actuation means for the purpose of easy operation. In addition, such devices are relatively more expensive than the present device and do not really attract attention. There is a demand for a very effective signaling device on a restaurant table or bar to catch the attention of the bartender, waiter or waitress and which can be manufactured inexpensively to give a long period of service with a relatively small investment. In addition, the prior art devices are not easy to actuate and because they are arranged as lamps and lights do not really attract attention whereas the present device contains a noticeable light conduction portion at the top and also the instant device is an attention-getting novelty which attracts a customer to operate it.

SUMMARY OF THE INVENTION

An object of this invention is to provide a combination signal light and ashtray for use on restaurant tables, bars and the like.

Another object of this invention resides in the quick-flip switch which is easily flipped by the finger or back of the hand into an on or off position to signal the desirability for service.

Another object of this invention resides in the combination of an elongated signal light conducting member having a fluorescent cavity at the top and bottom which provides a very noticeable light when the device is actuated.

Still another object of this invention resides in the aforementioned objects together with the fact that the device may be made self-contained with small batteries which eliminates the need for plugging into a wall outlet or the danger of electric shock or the like.

An additional object of this invention resides in the construction of the switch actuator device, the cap, the collar and the upwardly extending light conducting portion.

Another feature of this invention is the arrangement of the two-handle switch which is easily turned on and operated by the back or front of the hand or fingers.

Other and further objects and advantages of this invention will become apparent upon reading the following specification taken in conjunction with the accompanying drawings.

DESCRIPTION OF THE PREFERRED EMBODIMENT

Figure 1:
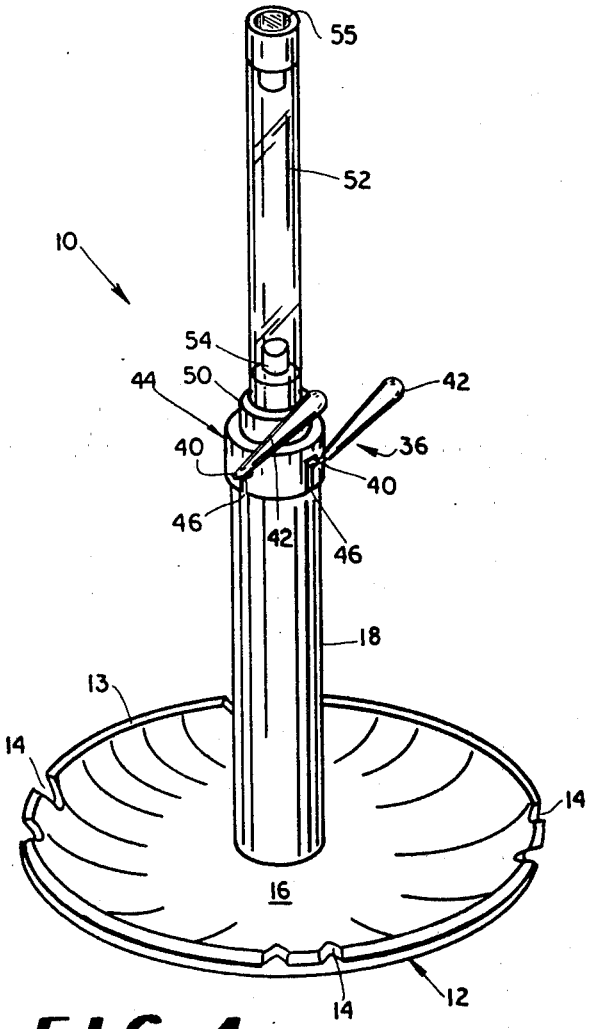
FIG. 1 is a perspective view of the combination ashtray and signal light of the present invention.
Figure 2:
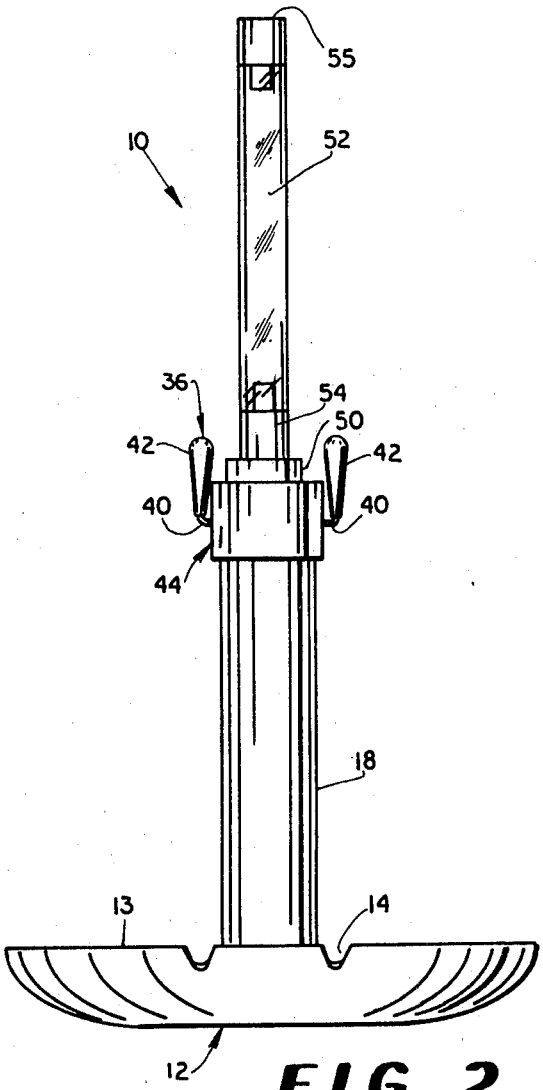
FIG. 2 is a side elevation view of the device shown in FIG. 1.
Figure 3:
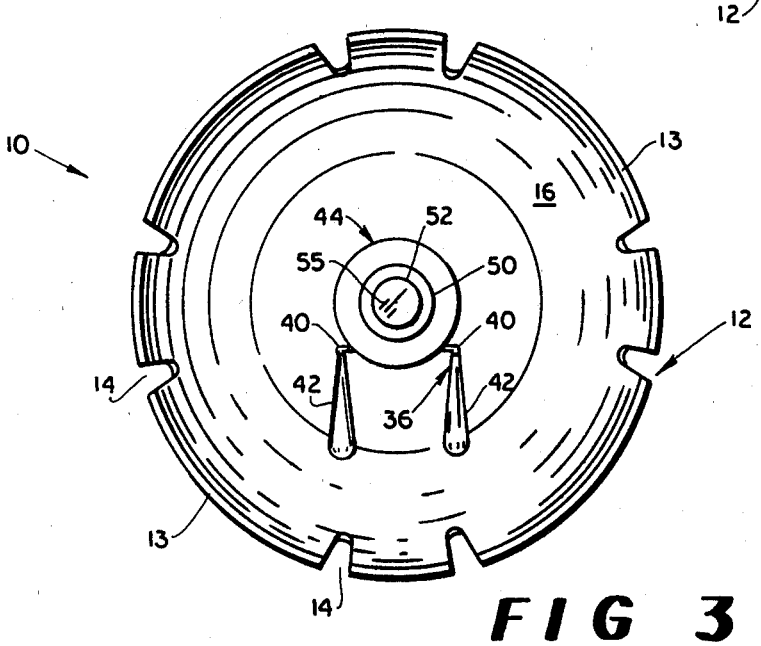
FIG. 3 is a top plan view of the device shown in FIGS. 1 and 2.

Referring initially to FIGS. 1 thru 3, inclusive, there is shown a signal device designated generally by reference numeral 10 and comprising a base 12 which may be constructed from cast metal, plastic, or the like, in a dish-like form thereby providing an ashtray 13 having cigarette notches 14 therein. Attached to the interior surface 16 of the base 12 is a tubular battery housing 18 constructed from chrome plated metal, or other suitable electrical conducting material and having therein a pair of batteries 20, 22 mounted on a bottom spring 23 welded to housing 18 giving a clear ground but leaving both ends of housing 18 open.

Figure 5:
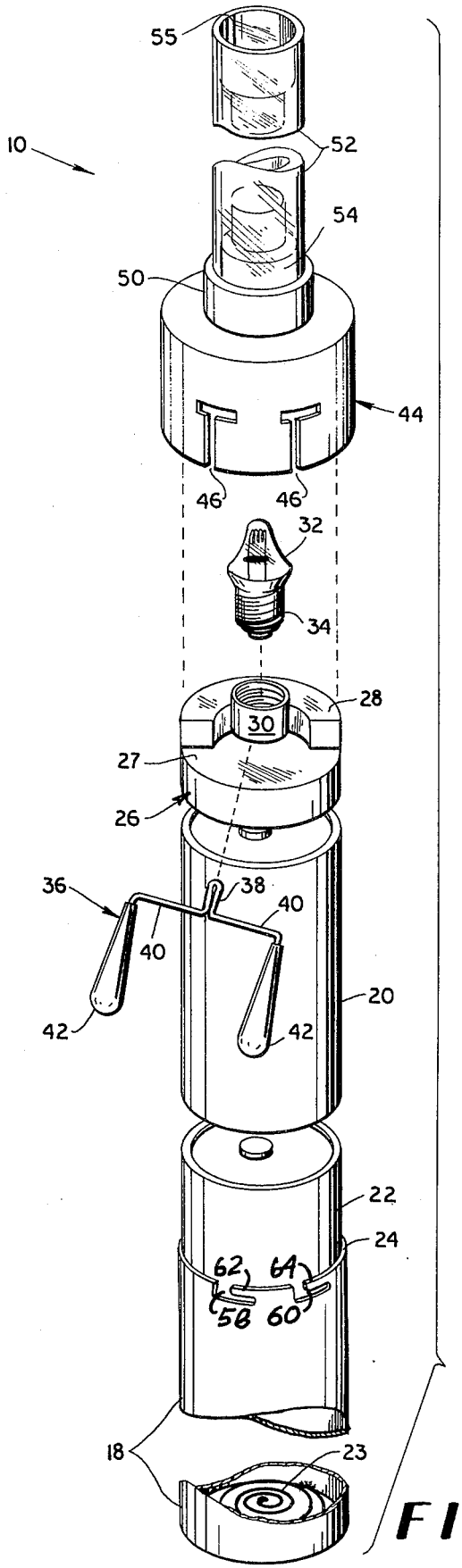
FIG. 5 is a disassembled assembly view of the device shown in FIGS. 1 thru 4, inclusive, with portions of the top and bottom broken away.
Figure 4:
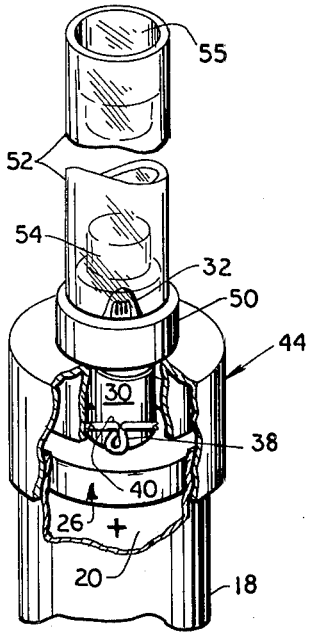
FIG. 4 is a perspective view of a portion of the device shown in FIGS. 1 thru 3, inclusive, with parts broken away.
Figure 6:
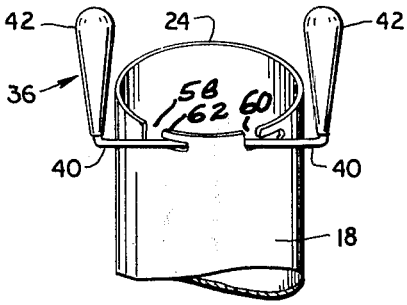
FIG. 6 is a perspective view of a detail.

Referring to FIGS. 4 and 5, housing 18 has an open socket at the top 25 thereof in which is positioned a plastic collar insert 26 having a cut-out portion 27 leaving a partial ring 28 in which is mounted a threaded collar 30 of conducting material which holds a conventional lightbulb 32 (such as a G.E. penlight) having a screw base 34 fitting in the collar 30 making electrical contact on one side of the circuit to the lightbulb 32 filament. The cut-out portion 27 of collar 26 and the discontinued portion of ring 28 leaves a space inside of the housing 18 in which is mounted a switch actuator designated generally by reference numeral 36 and comprising a bent wire having an interior electrical contact loop 38 and side extending portions 40 on each side bending 90 degrees and being provided with small plastic tips or handles 42 on each side.

As seen in FIG. 4, the assembled collar 26 is pressed down against spring 23 in the bottom by tube 50 and holds the light bulb 32 contact tip in firm engagement with the poles on the batteries 20.

The entire device is assembled by means of an assembly cap or cover member 44 of open cylindrical construction having a pair of T-slots 46 therein in which the wire portions 40 of the switch actuator 36 are mounted whereby when the loop 38 is in contact with the side of the light bulb 32 there is a circuit through the batteries, the spring 23, housing 18, thru the loop 38 and the filament of light bulb 32 causing the light 32 to light. This happens when the switch actuator 36 is flipped to the position of FIG. 1 from a higher position from the direction of the arrow thereby causing the loop 38 to touch the side of the conducting collar 30.

Mounted in a tube 50 extending thru the cap 44 is an elongated rod of "LUCITE" (trademark) plastic or any other light conducting material designated by reference numeral 52 and having a cavity 54 in the bottom thereof which fits over the top of bulb 32 thereby placing the light bulb 32 therein. Cavity 54 is filled with fluorescent paint as is a cavity 55 in the top. With this arrangement, when the light 32 is lighted the light therefrom is shielded by tube 50 and conducted up through the rod 52 causing the fluorescent paint to glow and an elongated shaft of light to extend from the top of the device 10 thereby providing a very noticeable signal to a bartender or waitress.

Notches 58, 60 in the top of housing 18 have respective projections 62, 64 beneath which the rod 40 is loosely captured in assembly whereby the switch actuator 36 is held in proper position when the slots 46 are matched. Thus, in assembly switch actuator 36 can move a limited amount from the position shown in FIG. 1 to turn the device 10 off or on as desired. In the off position the handles 42 are almost vertical but not vertical so that the loop 38 is depending downwardly out of contact held in place loosely by cap 44 in slots 46.

While I have shown and described a particular embodiment of this invention together with suggested mode of operation thereof this is by way of illustration only since various alterations, changes, deviations, eliminations, additions and departures may be made in the embodiment shown without departing from the scope of my invention as defined only by a proper interpretation of the appended claims.

What is claimed:

1. In a signal light device for signaling cocktail waitress, bartender or other person comprising:

a base to be supported on a surface such as a table; a light housing extending upwardly from said base and having electrical battery means therein; an elongated light conducting member mounted on and extending upwardly from said housing for conducting light upwardly therethrough; switch means on said housing comprising a flipswitch operating member movably mounted to be easily shifted, said operating member having a projecting center contact portion and arms extending therefrom on both sides; said housing having a notched out portion in which said operating member is mounted for partial confinement, a light bulb is in said housing, a conducting collar on said housing in which said light bulb is mounted, said switch contact portion being adjacent said collar for contacting same in one position and for non-contact therewith in another position, whereby said switch may be moved from a contact position to a non-contact position, and a cap covering said conducting collar, said cap having elongated slots extending upwardly therein in which said switch contact arms are confined for operation therein.

2. In a signal light device for signaling a cocktail waitress, bartender or other person comprising:

a base to be supported on a surface such as a table, in a cocktail lounge or the like, an elongated housing mounted on said base, said housing having a top and bottom, an open upper end, and a bore completely therethrough, a battery contact spring attached to the bottom of said housing and adapted to resiliently support and to make electrical contact with the bottom of a battery, at least one electrical battery mounted in said housing and being supported on said spring, a pair of off-set notches in said housing adjacent the open upper end of said housing, a switch operating member mounted in said notches and being at least partly confined in the off-set notches for limited arcuate movement therein, said switch operating member comprising a pair of opposite arms extending from a center electrical contact portion projecting inside said housing, a non-conducting retaining member inserted in said housing and having a space thereon in which is positioned the electrical contact portion of said switch operating member, a light bulb mounted on said nonconducting retaining member and having an electrical conducting portion thereon leading to the light filament therein and which electrical conducting portion is contactable with said contact portion in a certain position of said switch operating member, a cover member for the open upper end of said housing which extends over said light bulb and said retaining member, said cover member having a pair of off-set slots corresponding to the respective notches in said housing to accommodate each of a respective portion of said switch operating member to confine same for operation and to hold same in place, a light conducting member having first and second ends, said light conducting member having one end mounted through said cover and having a cavity in said one end in which said light bulb fits and the other end of said light conducting member extending upwardly therefrom whereby light from the light bulb is conducted along said light conducting member to the other end thereof.

3. The device in claim 2 wherein said cover member has a light shielding tube extending therethrough, one end of said tube surrounding said light bulb and the other end thereof supporting the one end of said light conducting member.

4. The device in claim 2 wherein there is a further cavity in said light conducting member in the other end thereof, said cavities having fluorescent paint thereon whereby light conducted in said member causes said paint to fluoresce.

* * * * *